US005551413A

United States Patent [19]

Walk

[11] Patent Number: 5,551,413

[45] Date of Patent: Sep. 3, 1996

[54] ARCHERY BOW HANDLE RISER WITH REPLACEABLE GRIP HEEL

[75] Inventor: Randy J. Walk, Tooele, Utah

[73] Assignee: Hoyt USA, Salt Lake City, Utah

[21] Appl. No.: 305,202

[22] Filed: Sep. 13, 1994

[51] Int. Cl.[6] ..... F41B 5/14

[52] U.S. Cl. ..... 124/88; 124/86; 124/23.1

[58] Field of Search ..... 124/88, 86, 23.1, 124/25.6; 42/73, 71.02

[56] References Cited

U.S. PATENT DOCUMENTS

| | | | |
|---|---|---|---|
| 1,049,739 | 1/1913 | Leach, Jr. | 42/71.02 |
| 2,832,166 | 4/1958 | Ivy | 42/71.02 X |
| 3,176,674 | 4/1965 | Smith | 124/23.1 |
| 3,407,799 | 10/1968 | Reynolds | 124/24.1 |
| 4,175,536 | 11/1979 | Carella | 124/23.1 |
| 4,759,337 | 7/1988 | Suski | 124/88 X |
| 5,070,856 | 12/1991 | Plummer | 124/88 |
| 5,241,945 | 9/1993 | Shepley, Jr. | 124/88 |
| 5,243,958 | 9/1993 | Shepley, Jr. | 124/88 |
| 5,373,831 | 12/1994 | Cushman | 124/88 X |

*Primary Examiner*—Anthony Knight
*Attorney, Agent, or Firm*—Mallinckrodt & Mallinckrodt

[57] ABSTRACT

An archery bow handle riser includes a hand grip portion with a self or integral throat portion and a heel member mounting portion to accept a variety of different replaceable heel members. In this way a narrow throat portion can be maintained while providing a wide variety of heel members to customize the hand grip as preferred by an individual archer.

9 Claims, 2 Drawing Sheets

ARCHERY BOW HANDLE RISER WITH REPLACEABLE GRIP HEEL

BACKGROUND OF THE INVENTION

1. Field

The invention is in the field of archery bow handle risers.

2. State of the Art

Traditionally, archery bow handle risers have had a hand grip portion formed integrally therewith. This is referred to as a self grip. The desire to be able to modify the hand grip portion of the riser to comfortably fit a wide variety of archers ' preferences for handle shape and fit has led in recent years to replaceable hand grip portions of the riser which generally take the form of a molded plastic or shaped wood handle that is positioned over a receiving portion of a handle riser and removably secured thereto.

A handle riser grip includes a throat portion where the thumb and forefinger of an archer holding the riser extend about opposite sides of the riser, and a heel portion which fits into the palm of the hand of the archer and about which the remaining fingers extend along one side. Replaceable hand grips provide a throat and heel portion which can be fit to the user 's hand. However, it is usually preferred to keep the throat portion of the grip relatively narrow so that the thumb and forefinger comfortably and securely fit around the throat. When constructing a handle riser, however, an important consideration is the structural strength of the riser since the riser is subjected to extreme stress when the bow is drawn. Therefore, the minimum thickness of the throat of the grip of the riser is usually determined by the required strength of the riser. In many cases, the minimum thickness of the throat (usually the thinnest part of the riser) required for strength in the riser is the comfortable thickness for the archer. When replaceable hand grips of the prior art are used, the thickness of the replaceable grip is added to the required minimum thickness of the structural portion of the throat and results in a thicker throat than most archers prefer.

SUMMARY OF THE INVENTION

According to the invention, it has been found that most archers are satisfied with a standard, relatively narrow grip throat, and that the differences in a hand grip needed to customize the grip to meet the wide variation in archers' preferences usually relate to changes in the heel portion of the grip, i.e., the portion of the grip that extends into the archer's palm. Thus, an archery bow handle riser of the invention has an integral grip throat and is configured adjacent such grip throat to receive a removable grip heel portion. This allows the grip heel portion to be changed and adjusted to the preferences of the archer while maintaining a preferred narrow throat configuration.

The bow handle riser of the invention includes a riser body with opposite ends adapted to have bow limbs attached thereto. A hand grip throat portion of the riser is located intermediate the riser body to be held between the thumb and forefinger of an archer holding the riser, and a hand grip heel mounting portion is positioned adjacent the hand grip throat portion to removably accept a hand grip heel member. The hand grip mounting heel portion is preferably formed with substantially parallel, flat sides, although cut outs or recesses in the sides may be present. A hand grip heel member includes a slot therein with substantially parallel, flat sides so that the heel member slot fits over and accepts the heel member mounting portion of the riser body therein, and extends therefrom to form the heel portion of a hand grip which fits comfortably into the palm of an archer holding the riser when the archer's thumb and forefinger are positioned to hold the neck portion of the riser. The heel member is removably secured to the heel member mounting portion of the riser such as by screws.

With a replaceable hand grip heel member, the heel portion of the hand grip of the riser can be changed to conform to the desires of individual archers without changing the throat portion of the hand grip.

THE DRAWINGS

The best mode presently contemplated for carrying out the invention is illustrated in the accompanying drawings, in which:

FIG. 1 is a side elevation of an archery bow with a handle riser of the invention;

FIG. 2, an enlarged, fragmentary side elevation of the portion of the handle riser which includes the hand grip of the invention, a portion of the hand grip heel member being broken away and shown in section;

FIG. 3, a substantially horizontal section taken on the line 3—3 of FIG. 2;

FIG. 4, a view similar to that of FIG. 2, but showing a hand grip heel member of different configuration;

FIG. 5, an assembly view of the portion of the bow handle riser shown in FIGS. 2 and 4, but with the heel member separated therefrom;

FIG. 6, a fragmentary front elevation taken from the right side of FIG. 2;

FIG. 7, a fragmentary side elevation similar to that of FIG. 2, but taken from the opposite side and showing in broken lines a hand as it would hold the bow for shooting; and FIG. 8, a fragmentary side elevation similar to that of FIG. 4, but taken from the opposite side and showing in broken lines a hand as it would hold the bow for shooting.

DETAILED DESCRIPTION OF THE ILLUSTRATED EMBODIMENT

Figure 1:
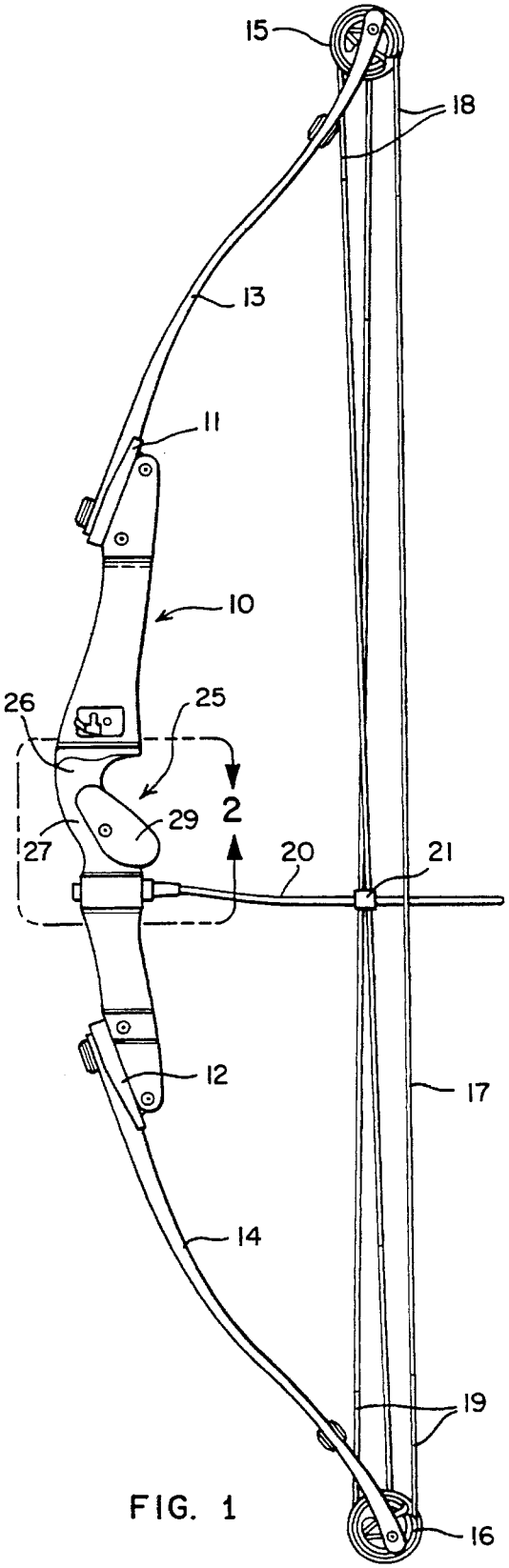
Figure 2:
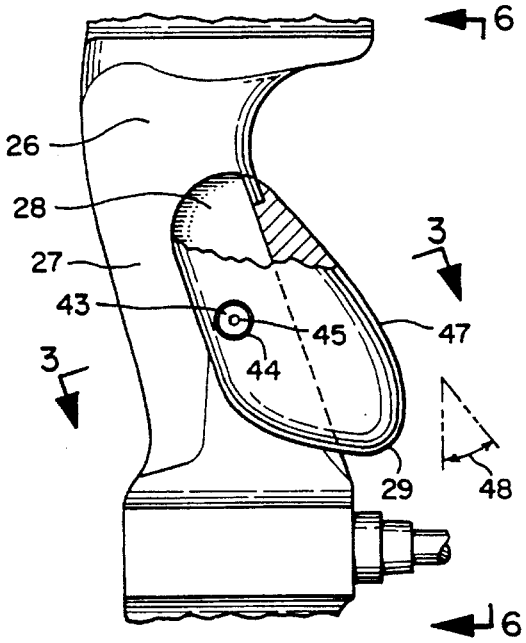
Figure 3:
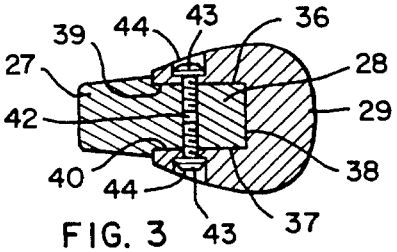

A compound archery bow includes a handle riser 10 with means, here shown as upper and lower limb mounting plates 11 and 12, respectively, to mount upper and lower limbs 13 and 14, respectively, to the respective ends of the handle riser 10. Wheels 15 and 16 are mounted for eccentric rotation at the ends of limb 13 and 14, respectively, and a bow string 17 extends between buss cables 18 and 19 trained around wheels 15 and 16. A cable guard 20 extends from attachment to riser 10 with a cable retaining member 21 slidably mounted thereon. This is representative of standard compound archery bow construction. A recurve bow may be similarly constructed, but would not have the wheels 15 and 16 mounted on the ends of the limbs. Instead, a bowstring is connected directly between respective outer limb tips. Also, while the handle riser 10 is shown as a separate piece with limbs 13 and 14 attached thereto, and this is generally representative of modern compound and recurve bow construction, the handle riser and bow limbs could be formed integrally. Even with integral construction, however, the limbs can be considered as secured to and extending from the ends of the handle riser.

Figure 4:
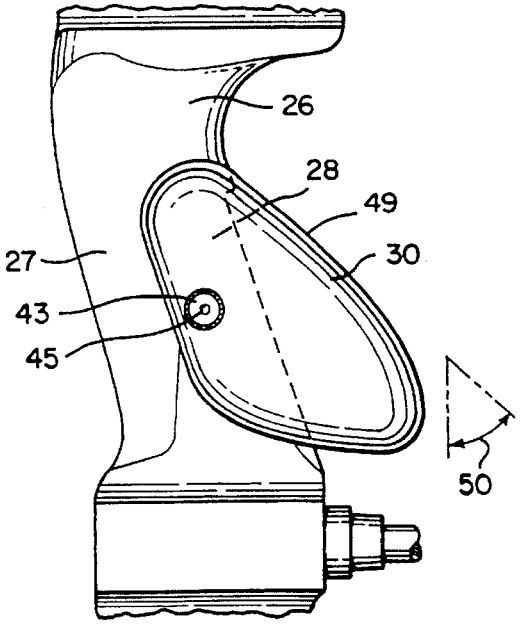

The handle riser 10 has a hand grip portion, indicated generally as 25, FIG. 1, located intermediate the ends of the handle riser which an archer grasps with one hand to hold the archery bow for shooting. The hand grip portion includes a hand grip throat portion 26 and hand grip heel portion 27 which includes a heel member mounting portion 28 and replaceable heel member 29 in FIGS. 1–3 , 5–7 and 30 in FIGS. 4 and 8. When an archer holds the handle riser and bow for shooting, the archer's thumb and forefinger extend around the throat portion 26 of the hand grip, the thumb 31 is shown in broken lines in FIGS. 7 and 8 and the forefinger 32 would extend at the same level but on the other side of the throat, with the end showing at the edge of the grip, while the palm 33 of the archer's hand is against the heel member 29 or 30.

Figure 6:
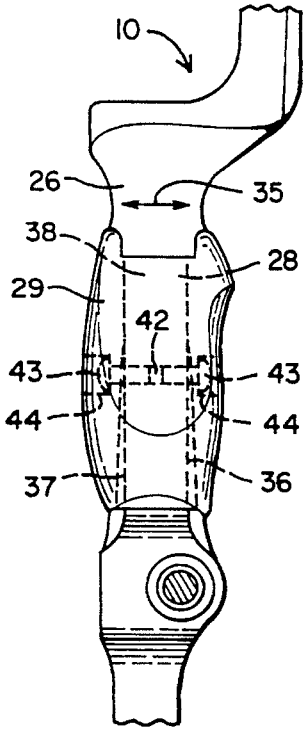

In most situations it is desirable to have the throat portion of the hand grip relatively narrow in width 35, FIG. 6, so that it can be tightly gripped by the archer's thumb and forefinger. This width, depending upon the material from which the handle riser 10 is made, is generally determined by the strength of the handle riser material since the throat has to be strong enough to withstand the stresses placed on the riser when the bow is drawn. Therefore, there is generally a minimum width dimension which can be had for the throat. In the case of the present invention, as long as the minimum width of the throat for structural strength is met, the width is then determined to be the most universally comfortable width and shape. With the invention, the throat is a self throat, meaning that it is integral with the riser itself. There is no separate handle piece to add to the width of the throat once it is determined and formed as part of the riser. With a relatively narrow throat so a good grip around the throat is obtained by the archer, generally the bow can be held more steadily and more accuracy is obtained in shooting the bow.

Figure 5:
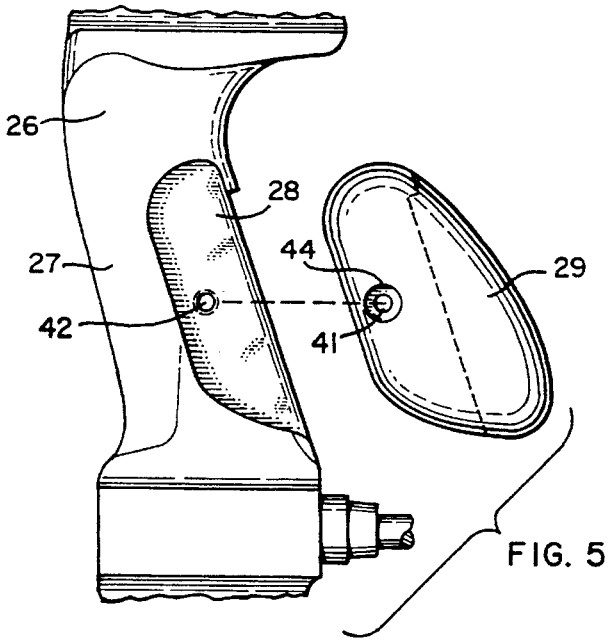

While it has been found that a single configuration of the throat is generally satisfactory for most archers, the preferred configuration of the heel portion of the grip for most archers varies. Thus, it is usually advantageous to be able to vary this configuration. For this purpose, handle riser 10 is provided with a hand grip heel member mounting portion 28 adjacent the throat portion 26. The heel member mounting portion has substantially parallel, flat sides 36 and 37, FIGS. 3 and 6. The hand grip heel member 29 or 30 is provided with a groove 38, FIG. 3, also having substantially parallel, flat sides 39 and 40 which fit over the sides 36 and 37 of the heel member receiving portion of the riser when it is received in handle member groove 38. Holes 41, FIG. 5, extend through the sides of handle members 29 or 30 to mate with threaded hole 42, FIGS. 3 and 5, extending through the heel member receiving portion of the riser when the heel member is mounted on the heel member receiving portion of the riser. Screws 43 extend through heel member holes 41 and are tightened into threaded hole 42 to secure the heel member to the riser. Holes 41 are counter sunk as at 44, FIGS. 3 and 5, to accept the heads of screws 43, and screws 45 are preferably provided with a hex hold 43, FIGS. 2 and 4, to accept an allen wrench for tightening or loosening. With screws 43 removed, the heel member may be easily removed from the riser as shown in FIG. 5.

The heel members 29 or 30 can be made of various materials such as shaped wood, molded plastic, or other materials.

Figure 7:
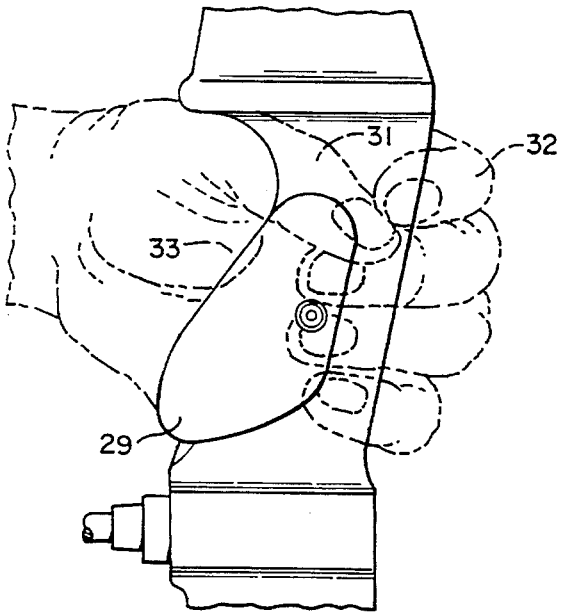
Figure 8:
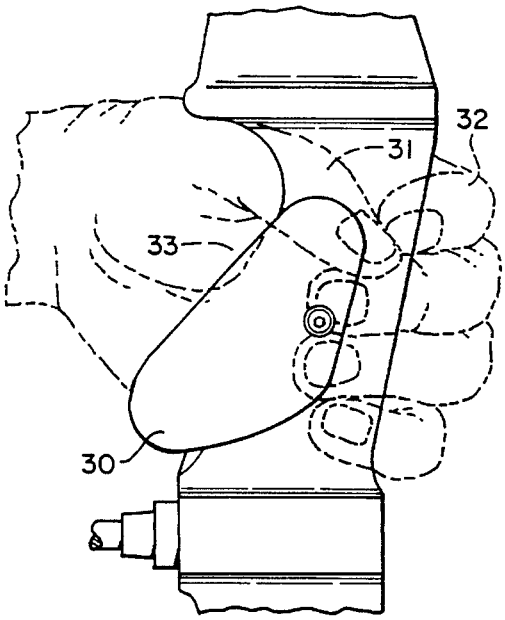

Heel members of various configuration can be provided so that an archer can obtain and secure to the riser a heel member which fits his or her hand and has the configuration the archer prefers. For example, heel member 29 has a palm contacting surface 47 extending from the riser at an angle 48 to vertical, FIG. 2, while heel member 30 has a palm contacting surface 49 extending at a greater angle 50. This changes the hand position with respect to the handle riser as shown in FIGS. 7 and 8. Heel members may also be provided of different width for small or large hands and can have other variations as desired. However, with all of the variations of the heel member to fit various hands, the narrow throat configuration as built into the riser remains the same.

While a particular riser configuration has been illustrated, it should be realized that the invention may be used with a wide variety of riser configurations and with risers made of various materials. Further, where the materials are such that strength is maintained with various cut-outs or recesses provided, the sides of the heel member mounting portion could have recesses cut thereinto to reduce the weight of the riser, or for other desired purposes. However, substantially parallel, flat sides remain such even if the sides have one or more recesses provided therein. In addition, various configurations for the sides of the heel member mounting portion could be used and the slot of the heel member configured to fit thereover, or the heel member otherwise configured to be secured thereto.

If it becomes desirable to be able to adjust the throat portion of the hand grip along with the heel portion, a separate throat member mounting portion could be provided at the throat and various throat members can be provided to adjust the throat thickness and configuration independently of the heel configuration. This would provide increased flexibility over replaceable handle members of the prior art which integrally include both the throat and heel portions since fewer throat configurations could be used independently with a much wider range of variations in the heel members.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. An archery bow handle riser comprising a riser body having opposite ends to which blow limbs may be attached; a hand grip throat portion intermediate the riser body between the ends of the riser body configured to be held between the thumb and the forefinger of an archer holding the riser; and a hand grip heel member mounting portion adjacent the hand grip throat portion configured to removably accept a hand grip heel member that is separate and apart from the hand grip throat portion.

2. An archery bow handle according to claim 1, additionally including a hand grip heel member removably received on the hand grip heel mounting portion of the riser body; and means for removably securing the hand grip heel member in received position on the handle riser; whereby the palm of the hand of an archer holding the riser is positioned on the hand grip heel member when the thumb and forefinger of the archer's hand are positioned to hold the throat portion.

3. An archery bow handle according to claim 2, wherein the hand grip heel mounting portion has substantially parallel, flat sides, and the hand grip heel member has a slot therein with substantially parallel, flat sides which fit over and accept the hand grip heel mounting portion therein.

4. An archery bow handle according to claim 2, wherein the means for removably securing the hand grip heel member in received position on the handle riser is at least one screw which extends through the heel member into the heel member mounting portion of the riser.

5. An archery bow handle riser comprising a riser body having opposite ends to which bow limbs may be attached and a hand grip intermediate the riser body between the ends thereof, and including a hand grip throat portion and a hand grip heel portion, said hand grip heel portion comprising a hand grip heel member mounting portion configured to removably accept a hand grip heel member; a hand grip heel member separate from the hand grip throat portion removably received on the hand grip heel mounting portion so that the palm of a hand of an archer holding the riser is positioned on the hand grip heel member when the thumb and forefinger of the archer's hand are positioned to hold the separate throat portion of the riser.

6. An archery bow handle riser according to claim 5, wherein the hand grip throat portion of the riser is integrally formed with the riser.

7. An archery bow handle riser comprising a riser body having a hand grip intermediate the riser body; and separate hand grip throat and hand grip heel portions of said hand grip, said separate hand grip heel portion being formed by a hand grip heel member separate from the hand grip throat portion of the hand grip which is secured to the riser body adjacent the hand grip throat portion.

8. An archery bow handle riser according to claim 7, wherein the hand grip heel member is removably secured to the riser body.

9. An archery bow handle riser according to claim 7, wherein the throat portion of the hand grip is integrally formed with the riser body.

* * * * *